US005934232A

United States Patent [19]

Greene et al.

[11] Patent Number: 5,934,232

[45] Date of Patent: Aug. 10, 1999

[54] ENGINE VALVE LIFT MECHANISM

[75] Inventors: Cynthia Ann Greene, Rochester; Mark James Spath, Spencerport; Michael James Fox, Stafford, all of N.Y.

[73] Assignee: General Motors Corporation, Detroit, Mich.

[21] Appl. No.: 09/097,117

[22] Filed: Jun. 12, 1998

[51] Int. Cl.[6] ..... F01L 1/14; F01L 13/00

[52] U.S. Cl. ..... 123/90.16; 123/90.5; 123/90.55

[58] Field of Search ..... 123/90.15, 90.16, 123/90.17, 90.48, 90.49, 90.5, 90.55

[56] References Cited

U.S. PATENT DOCUMENTS

| | | | |
|---|---|---|---|
| 3,108,580 | 10/1963 | Crane, Jr. | 123/90.5 |
| 3,998,190 | 12/1976 | Keske | 123/90.5 |
| 4,089,234 | 5/1978 | Henson et al. | 123/90.5 |
| 4,207,775 | 6/1980 | Lintott | 123/90.5 |
| 5,022,356 | 6/1991 | Morel, Jr. et al. | 123/90.5 |
| 5,090,364 | 2/1992 | McCarroll et al. | 123/90.16 |
| 5,351,662 | 10/1994 | Dopson et al. | 123/90.16 |
| 5,398,648 | 3/1995 | Spath et al. | 123/90.16 |
| 5,431,133 | 7/1995 | Spath et al. | 123/90.16 |
| 5,555,861 | 9/1996 | Mayr et al. | 123/90.16 |
| 5,560,329 | 10/1996 | Hayman | 123/90.31 |
| 5,746,165 | 5/1998 | Speil et al. | 123/90.16 |

*Primary Examiner*—Weilun Lo

*Attorney, Agent, or Firm*—Karl F. Barr Jr.; Vince A. Cichosz

[57] ABSTRACT

Valve lift mechanism for an engine includes a two step variable valve lifter having roller followers for engaging multiple cams on an associated camshaft of the engine and an anti-rotation guide mounted in the engine externally of a cylindrical bore receiving the lifter. The guide engages an axial guide recess in the lifter body without requiring a corresponding recess in the bore. The lifter also has a saddle in a central low lift cam follower engagable by lock pins in an annular body of an associated high lift cam follower to lock the followers together for high valve lift operation. The saddle is disposed axially between a follower roller and a high pressure chamber of a hydraulic lash adjuster of the low lift cam follower so that lock pin loads are transmitted as compressive forces through the low lift follower. The high lift follower rollers are received in pockets having sides that are crowned by shallow convex curvatures defining axially extending ridges which limit axial motion of the rollers so that the rubbing surface and associated friction are limited. Various additional specific features are disclosed. Application of the features to other valve lifters and cam followers is anticipated.

17 Claims, 7 Drawing Sheets

ENGINE VALVE LIFT MECHANISM

TECHNICAL FIELD

This invention relates to engine valve lift mechanisms including features usable with various types of valve lifters.

BACKGROUND OF THE INVENTION

U.S. Pat. No. 5,398,648, granted May 21, 1995 to the assignee of the present invention, discloses engine valve lift mechanisms utilizing various types of valve lifters. These include cam actuated variable and non-variable lift, roller and non-roller type lifters of both direct and non-direct acting types for overhead, in-head and in-block camshaft engines.

SUMMARY OF THE INVENTION

The present invention provides features usable with one or more of the various types of valve lifters that may be used in engines.

A feature of the invention, applicable to various engine arrangements with cylindrical body lifters, provides an anti-rotation guide that extends into a lifter bore without requiring a groove or other modification of the bore. The guide includes a leg received in a slot in the lifter body and has an angled mounting portion that may be mounted loosely in a slot or recess in an engine block or other support. A screw retains the guide through a spring washer or the like to allow slight rotation of the lifter to a centered position of a follower roller on a camshaft, thereafter frictionally resisting free movement of the lifter away from the operationally centered position.

Another feature for variable lift type valve lifters provides a continuous saddle in an inner lifter for receiving locking pins extending from an outer lifter. The saddle is located between a cam engaging portion, such as a roller lifter, and load carrying portion, such a high pressure chamber of a hydraulic lifter, so that the lifter piston or body is loaded in compression. Angled sides and contoured end edges of the saddle may be provided to assist entry of the locking pins and minimize stresses during the locking action.

Still another feature for use with roller lifters is the provision of roller pockets or posts having opposite sides engagable with a roller for limiting its axial motion. The sides are provided with convex cylindrical curvatures defining ridges transverse to the roller axle pins. Engagement of the rollers, or needle bearings associated therewith, is thereby limited to the high points of the ridges, thus limiting friction from contact of the rollers with the sides of the pockets or posts.

These and other features and advantages of the invention will be more fully understood from the following description of certain specific embodiments of the invention taken together with the accompanying drawings.

DESCRIPTION OF THE PREFERRED EMBODIMENT

Figure 1:
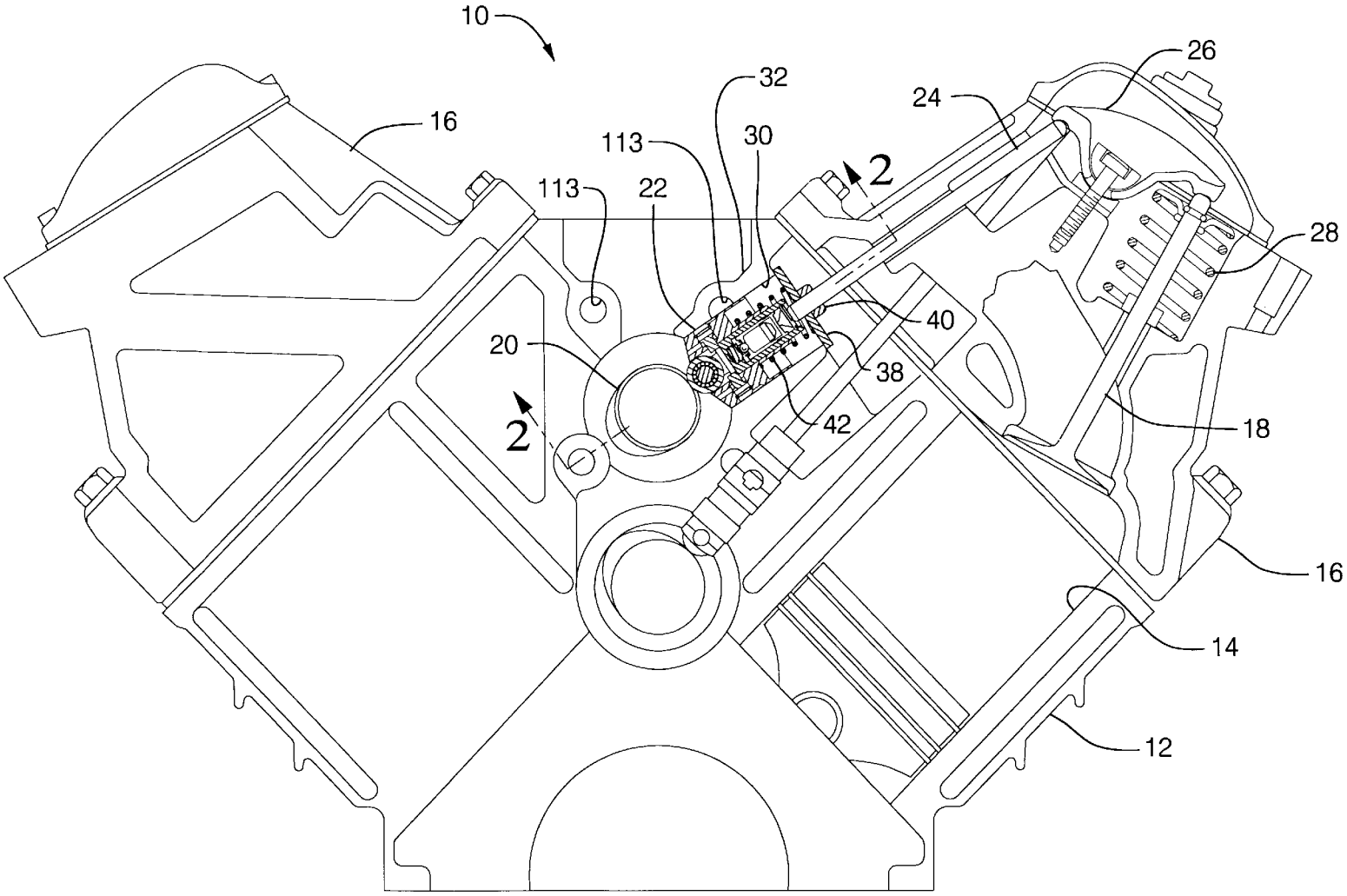
FIG. 1 is a cross-sectional view of an engine including one form of valve lift mechanism according to the invention.

Referring now to FIG. 1 of the drawings in detail, numeral 10 generally indicates an internal combustion engine including an engine cylinder block 12 having multiple cylinders 14 closed by cylinder heads 16. The cylinder heads carry intake valves 18 and exhaust valves, not shown, for controlling the admission and discharge of air-fuel mixture and exhaust gases to and from the cylinders. The valves are actuated by valve lift mechanism including at least one camshaft 20 carried in the cylinder block, intake valve lifters 22 driven by cams on the camshaft, and push rods 24 connecting the lifters with rocker arms 26 which engage the intake valves 18 for opening them in timed relation to engine speed as controlled by the rotation of the camshaft. Valve springs 28 bias the valves closed except when opened by the valve lift mechanism.

Referring to FIGS. 1–4, the valve lifter 22, illustrated as exemplary of certain features of the invention, is of a type known as a roller variable hydraulic valve lifter (RVHVL). (FIG. 4 of the previously mentioned U.S. Pat. No. 5,398,648 shows a prior art lifter having some similar features of structure and operation.) Valve lifter 22 is received for reciprocating motion in a bore 30 of a lifter gallery 32 formed in the cylinder block 12 adjacent the camshaft 20. Longitudinally spaced on either side of each bore 30 are two retainer posts 34, 36 on which a retainer plate 38 is mounted by flange bolts 40. Plate 38 retains a return spring 42 that engages an annular spring seat 43 and urges an outer portion of the lifter 22 toward contact with the camshaft 20.

Figure 2:
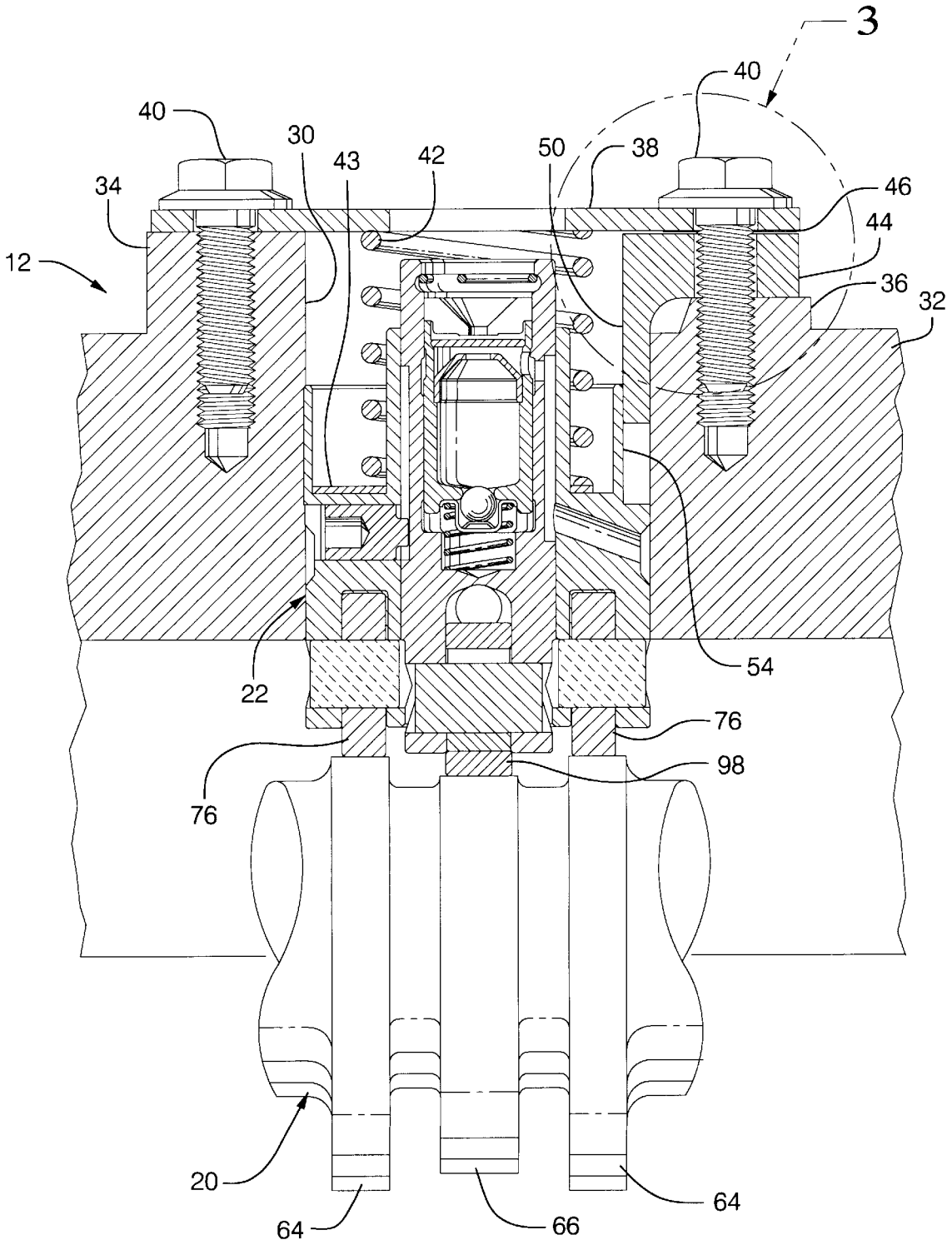
FIG. 2 is an enlarged cross-sectional view of the valve lifter and anti-rotation guide mounting as seen from the line 2—2 of FIG. 1.
Figure 3:
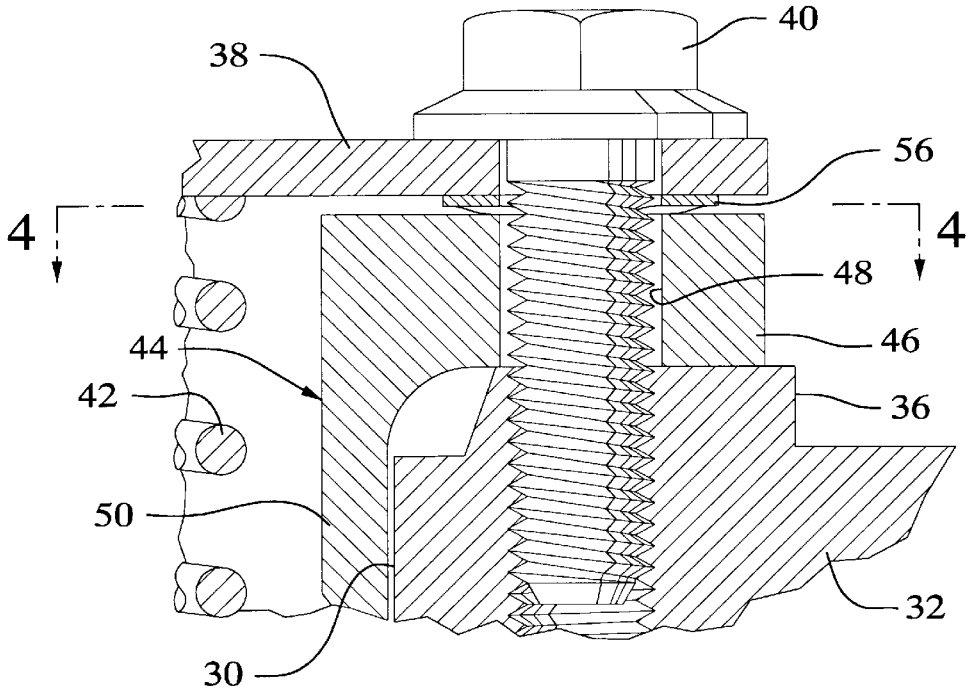
FIG. 3 is an enlarged cross-sectional view of the circled portion of FIG. 2.
Figure 4:
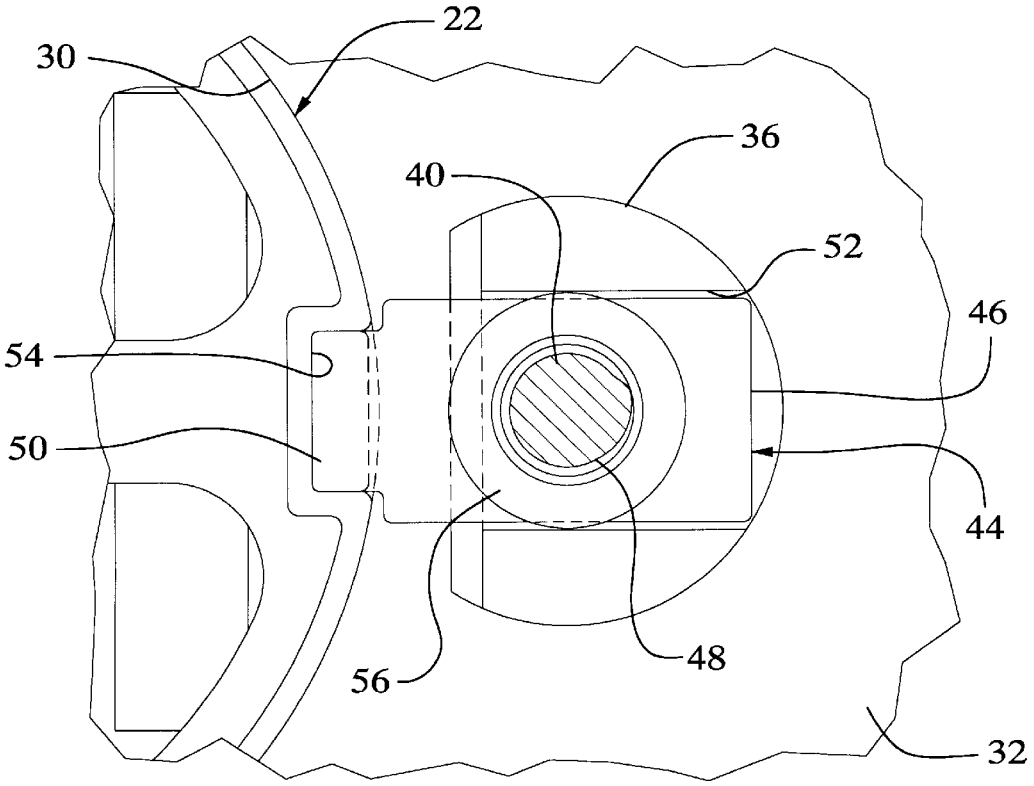
FIG. 4 is a cross-sectional view from the line 4—4 of FIG. 3.
Figure 10:
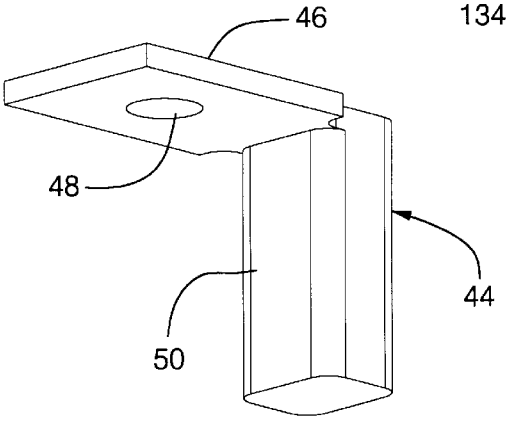
FIG. 10 is a pictorial view of the anti-rotation guide shown in FIGS. 1–3.

In order to prevent rotation of the lifter 22 within the bore 30, an anti-rotation guide 44 is provided as shown in FIG. 10. The guide 44 includes a generally rectangular mounting portion 46 having a central fastener opening 48. A narrower rectangular leg 50 extends downward at a right angle to the mounting portion. In use, as shown in FIGS. 2–4, the mounting portion 46 is received in a mounting slot 52 formed in the upper end of the retainer post 36. The guide 44 is positioned by the slot 52 and the bolt 40 that extends through the fastener opening 48 so that the leg 50 protrudes downward into an edge of the lifter gallery bore 30. There the leg 50 is received within a guide slot 54 formed in the lifter as will be subsequently more fully described.

Clearance is provided between the guide mounting portion 46 and adjacent sides of the mounting slot 52 so that the guide can move slightly to allow self centering of the lifter during rotation of the camshaft. To permit this, the mounting portion 46 is engaged by resilient means such as a wave spring washer 56 located between the retainer plate 38 and the top of the mounting portion 46. The spring force generates friction in the mounting that allows self centering of the lifter and then frictionally resists free movement of the lifter away from its centered position. This self centering action is not provided for in the lifter guide arrangement shown in FIGS. 10 and 11 of the previously mentioned U.S. Pat. No. 5,398,648 which also requires machining of the lifter gallery bore to form a matching groove for the guide.

Figure 11:
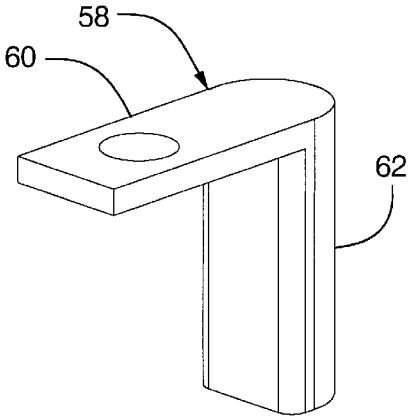
FIG. 11 is a pictorial view showing a modified form of anti-rotation guide.

FIG. 11 shows an alternative embodiment of anti-rotation guide 58 having a rectangular mounting portion 60 angularly connected with a leg 62 of generally semi-circular cross section. The corners of the flat and arcuate sides of the leg 62 may be rounded or chamfered to avoid abrasion of the bore and assist self centering action of the lifter.

Figure 5:
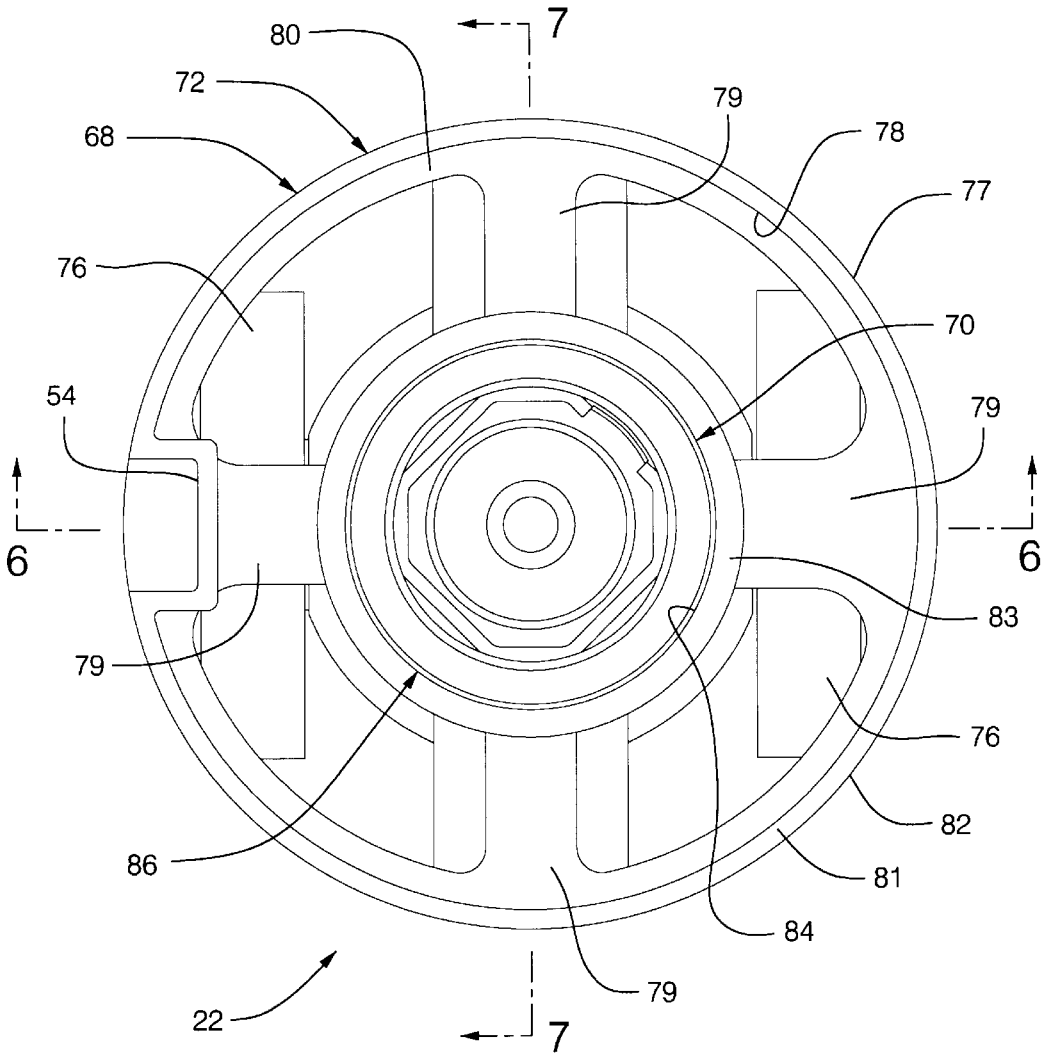
FIG. 5 is a top view of an exemplary embodiment of two step roller variable hydraulic valve lifter as shown in FIGS. 1–3 and having features in accordance with the invention.
Figure 6:
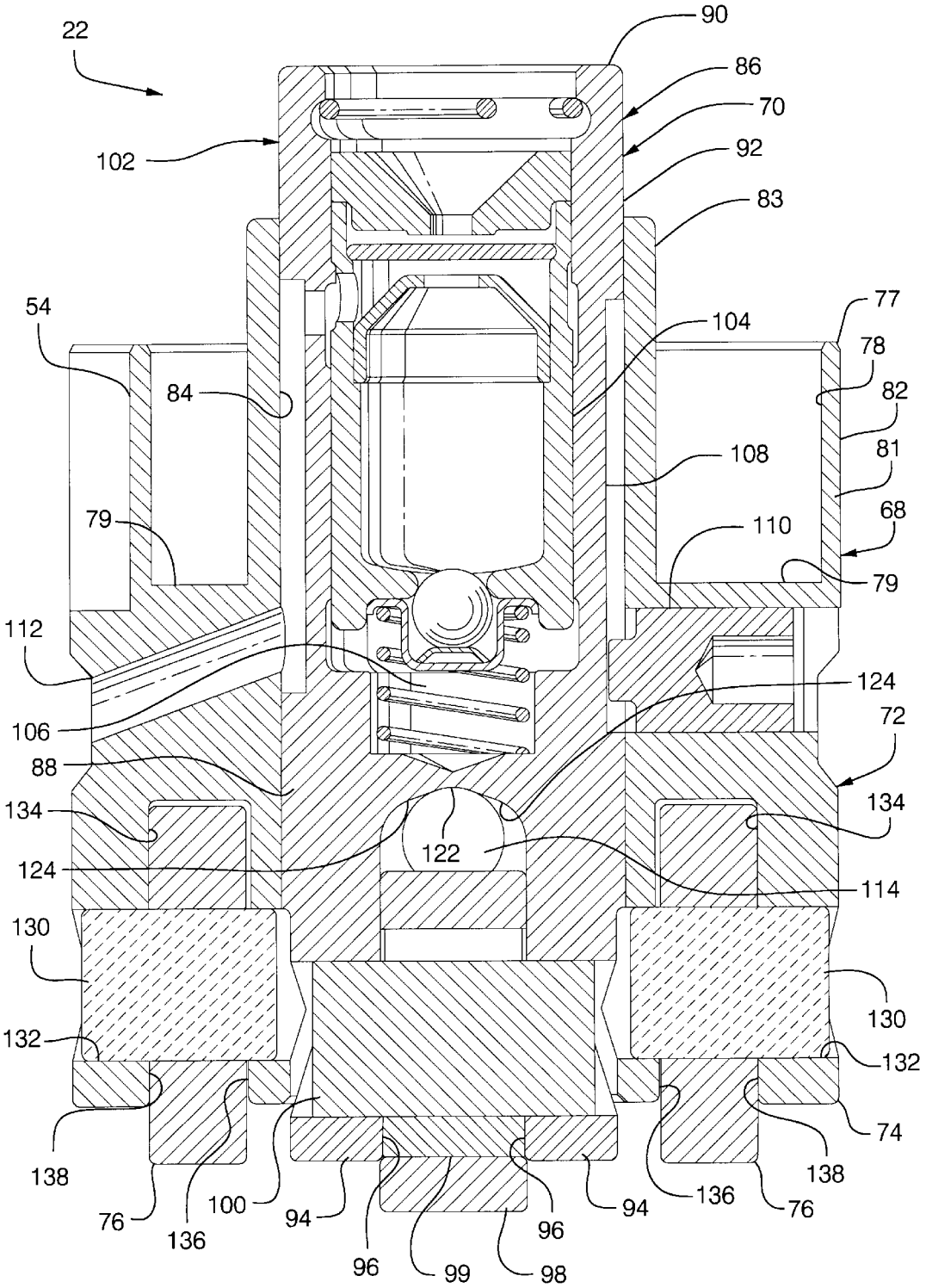
FIG. 6 is a cross-sectional view from the line 6—6 of FIG. 5.
Figure 7:
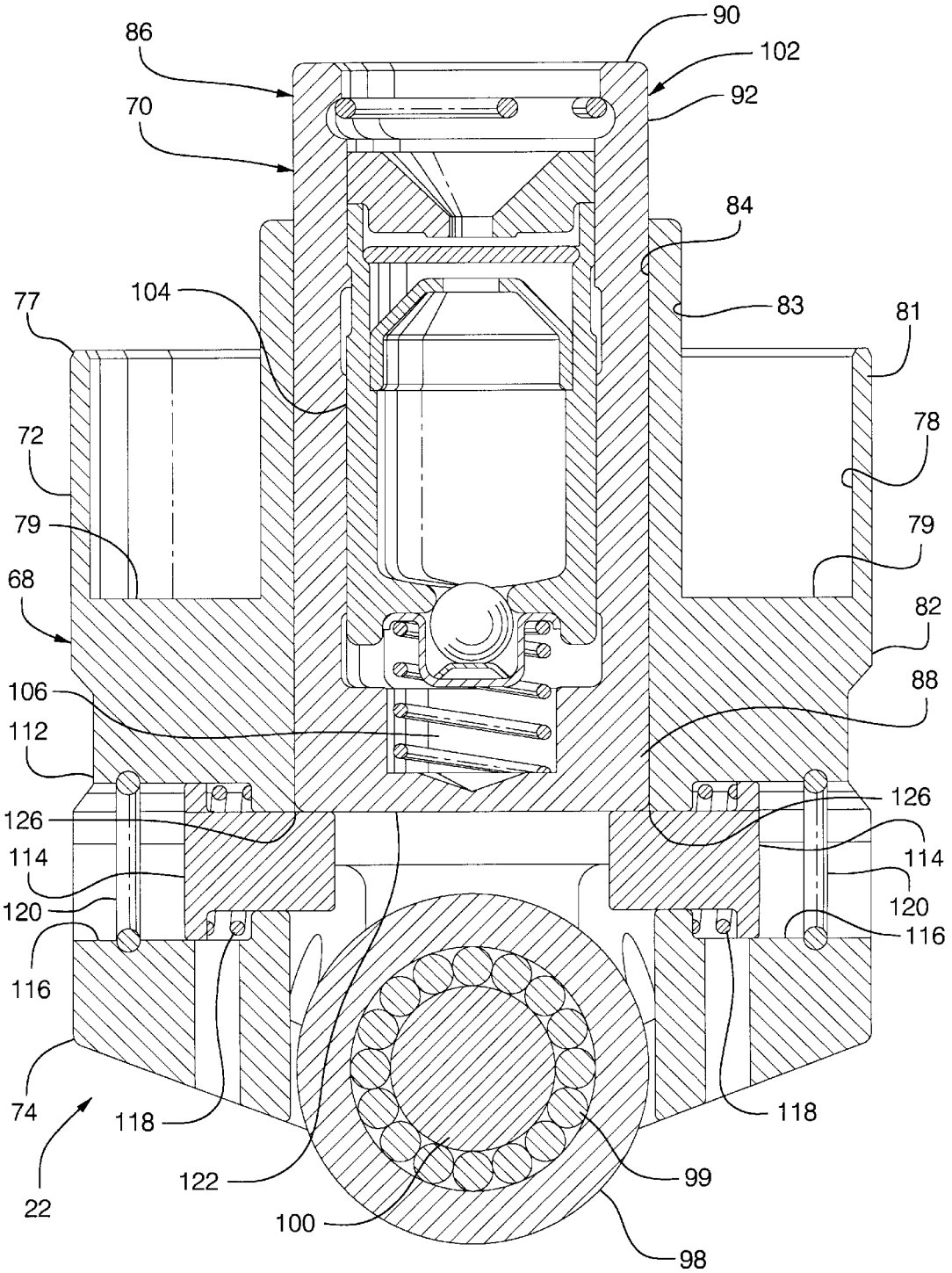
FIG. 7 is a cross-sectional view from the line 7—7 of FIG. 5.
Figure 8:
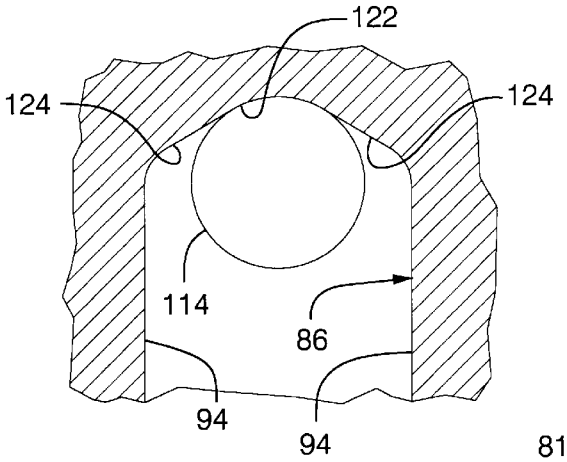
FIG. 8 is an enlarged cross-sectional view showing the saddle and a locking pin as engaged in the lifter.

FIGS. 5–7 show in further detail the RVHVL (lifter) 22 while FIG. 2 shows its engagement with the camshaft 20. Each lifter 22 is a two step RVHVL selectively actuated by a pair of spaced high lift cams 64 and a central low lift cam 66 located on the camshaft between the high lift cams 64. The lifter 22 includes a high lift outer cam follower 68 actuated by the high lift cams 64 and a low lift inner cam follower 70 actuated by the low lift cam 66.

The outer follower 68 has a cylindrical annular body 72 that is reciprocable in the lifter gallery bore 30. A first annular end 74 of the body includes first cam engaging portions, in this embodiment having the form of laterally spaced cam engaging rollers 76 which engage the high lift cams 64. An opposite second annular end 77 of the body includes a recess 78 in which the spring seat 43 mounting the return spring 42 is seated on radial ribs 79 and an associated annular ledge 80. The body 72 also has an outer wall 81 with a cylindrical outer surface 82 in which the anti-rotation guide slot 54 is formed and an inner wall 83 with a concentric cylindrical inner surface 84.

The low lift inner cam follower 70 includes a hollow piston 86 with a closed end 88, an open end 90 and a cylindrical wall 92 slidingly engaging the inner surface 84 of the body 72. The closed end 88 carries bifurcated axially extending struts 94 having spaced opposed sides 96 between which a follower roller 98 is carried rotatable on needle bearings 99 supported on a hardened steel axle pin 100 carried in the struts 94. Follower 70 further includes a hydraulic lash adjuster 102 including a plunger 104 having a check valve for controlling the admission of oil to a high pressure chamber 106 defined between the plunger 104 and the closed end 88 of the piston 86. A groove 108 in the wall 92 of the piston 86 is engaged by an anti-rotation pin 110 to prevent rotation of the inner cam follower 70 relative to the outer cam follower 68.

An annular groove 112 around the body 72 connects with a pressure gallery 113 in the engine block 12 (FIG. 1) to supply oil to the lash adjuster and through the push rods 24 to the associated rocker arms in known manner. The annular groove 112 also supplies oil to hydraulic locking pins 114 located in diametrically opposed bores 116 of the annular body 72. The locking pins 114 are biased outward by springs 118 and are forced inward when the gallery oil pressure is raised above a predetermined value. Retainer clips 120 in the bores 116 prevent excessive outward movement of the locking pins 114. When the locking pins 114 are actuated inward by increasing the gallery oil pressure, they engage a saddle 122 that extends laterally across the closed end of the hollow piston 86 between the struts 94. The saddle is located axially between the high pressure chamber 106 and the follower roller 98 for the low lift inner cam follower 70 so that valve actuating forces acting between the locking pins 114 and the saddle 122 are transmitted in compression from the pins 114 through the closed end 88 of the hollow piston 86 to the high pressure chamber 106 within the piston.

The saddle 122 is formed with a continuous concave cylindrical surface open toward the low lift roller 98 for engagement by the locking pins 114. The saddle 122 connects tangentially on arcuately opposite edges with angled lead-in sides 124 to form a modified V recess open in the direction of the locking pins with the saddle 122 cylindrical surface forming a closed base of the V recess. The radius of the saddle cylindrical surface may be made close to or slightly larger than the radii of the locking pins which engage the saddle to minimize stresses in the pins and the saddle. The angled lead-in sides 124 assist engagement so that close sizing of these radii may be permitted.

The intersections of the transverse saddle 122 V recess with the cylindrical outer wall 92 of the low lift cam follower hollow piston 86 form angular edges 126 which are engagable by the locking pins 114 during the act of engagement. These edges 126 are preferably contoured, such as by radii, chamfers or the like, to reduce their sharpness and thereby limit stresses in the hollow piston 86, due for example to partial engagements of the locking pins 114, that might cause wear or fracture at the saddle edges 126.

Figure 9:
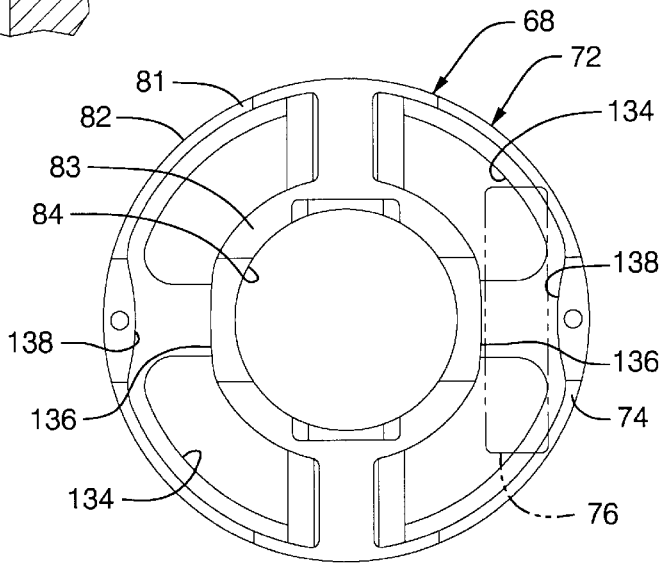
FIG. 9 is a bottom view of the cylindrical body for the lifter shown in FIGS. 5–7.

Referring now especially to FIGS. 6, 7, and 9, the spaced follower rollers 76 of the outer cam follower 68 are rotatable directly on ceramic axle pins 130 carried in transverse bores 132 of the annular body 72. Alternatively, needle roller bearings could be used if desired. The rollers 76 are received within pockets 134 opening through the first annular end 74 of the body 72. The pockets 134 have opposite inner and outer sides 136, 138, respectively formed on the inner and outer annular walls 83, 81 extending to the first annular end 74. In accordance with an optional feature of the invention, the opposite sides 136, 138 of the pockets 134 are formed with shallow convex cylindrical curvatures defining ridges transverse to the axle pins and preferably extending axially of the annular body 72 for ease of manufacture. The ridged or curved sides 136, 138 maintain the rollers 76 (and needle bearings if used) in their desired lateral positions with reduced friction because they engage the sides 136, 138 only along the inner ridges of the curved sides instead of along their full surface as is the case with planar sides. Also, the curved sides 136, 138 may be formed with adequate tolerances during formation of the annular body 72 by investment casting. Machining of the pocket sides 136, 138 may not be needed since the tolerances need be held only along the ridges and the amount of rubbing surface is minimized by the design. However, if needed, machining of the ridges could be done more easily since only a small amount of metal would need to be removed.

It should be apparent that the inner cam follower 70 could also have the sides 96 of struts 94 modified to provide shallow convex curved surfaces defining ridges similar to the pockets 134 of the outer cam follower 68. The ridges would then retain the roller 98 and the associated needle bearings 99 against excessive lateral motion on the axle pin 100.

While the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

We claim:

1. Valve lift mechanism for an engine, said mechanism including support means, a camshaft carried by the support means and having a pair of spaced cams, a valve lifter including a cam follower having a cylindrical body with first and second annular ends and an outer cylinder surface reciprocably carried in a cylindrical bore of the support means, the first annular end including a pair of laterally spaced first cam engaging portions engaging the cams, and guide means for limiting rotation of the body around an axis of reciprocation, the guide means characterized by:

an axially extending recess in the outer cylinder surface of the body; and an anti-rotation guide having a mounting portion mounted to said support externally of said bore by a through fastener holding a spring washer against the mounting portion for allowing limited pivotal motion of the mounting portion relative to the support, and a leg extending from the mounting portion axially within said bore and into said recess of the body;

wherein said bore is void of any axially extending guide recess, whereby limited lateral motion of the leg is permitted for self-centering of said valve lifter in said bore and sufficient frictional resistance is provided to prevent movement of the valve lifter from an attained self-centered position.

2. Valve lift mechanism as in claim 1 wherein said support includes spaced posts on opposite sides of and adjacent an end of said bore, a retainer plate secured to said posts, and a return spring between said plate and said second annular end of the body for urging the cam engaging portions against the cams, said guide means including a slot in one of said posts and loosely receiving said mounting portion of the guide for said limited pivotal motion, said spring washer being disposed between said plate and said guide mounting portion to provide said frictional resistance.

3. Valve lift mechanism as in claim 1 wherein said first cam engaging portions include:

spaced follower rollers supported on axle pins carried in transverse bores of said body, said rollers received within pockets opening through said first annular end of the body;

said pockets having opposite sides engageable with said rollers for limiting their sideward motion, said sides of the pockets being formed with shallow convex cylindrical curvatures defining ridges transverse to the axle pins and limiting engagement of the rollers with the sides of the pockets to engagement with said ridges.

4. Valve lift mechanism as in claim 3 wherein said ridges extend axially of the cylindrical body.

5. Valve lift mechanism as in claim 3 including needle bearings disposed between the rollers and the axle pins, said needle bearings being retained within the rollers by engagement with said ridges.

6. Valve lift mechanism as in claim 1 wherein the camshaft includes a low lift cam mounted between the spaced cams, which are high lift cams, the valve lifter is a two step variable lift type, the cam follower is a high lift cam follower, said body is annular having an inner cylinder surface concentric with the outer cylinder surface, and the valve lifter further includes a low lift cam follower including a hollow piston with at least one closed end, a second end and a cylindrical outer wall reciprocably engaging the inner surface of said body, the closed end including a second cam engaging portion generally between the first cam engaging portions, hydraulic lash adjusting means in the low lift cam follower and including a plunger reciprocable in said hollow piston and carrying a check valve, the plunger defining a high pressure chamber between the check valve and the closed end of the piston and an inner reservoir extending from the check valve toward the second end of the piston, and locking means for selectively locking the followers together for coincident reciprocating motion, said locking means including a saddle extending across the closed end of said hollow piston between the high pressure chamber and the second cam engaging portion, and hydraulic locking pins reciprocably mounted in said body of the high lift follower, said saddle having a concave cylindrical surface open toward said second cam engaging portion and engagable by said locking pins upon their hydraulic actuation inward from said body, thereby causing the low lift follower to reciprocate with the high lift follower.

7. Valve lift mechanism as in claim 6 wherein said saddle cylindrical surface connects on arcuately opposite edges with angled sides forming a modified V recess, open in the direction of said locking pins, and having the saddle cylindrical surface forming a closed base of the V recess.

8. Valve lift mechanism as in claim 7 wherein intersections of said saddle with said cylindrical outer wall of the low lift cam follower form angular edges engagable by said locking pins, said angular edges being contoured to reduce their sharpness and limit stresses in the body upon engagement of the locking pins.

9. An engine valve lifter including a cylindrical body having first and second ends, said first end including cam engaging means and said lifter including valve connecting means adjacent said second end of the body, said first end defining a pair of spaced opposite sides, said cam engaging means including a roller received between said opposite sides and rotatable on an axle pin carried in said opposite sides, lateral motion of the roller being limited by engagement with said sides, characterized in that:

said opposite sides are formed with shallow convex cylindrical curvatures defining ridges transverse to the axle pin and limiting engagement of the roller with said opposite sides to engagement with said ridges.

10. An engine valve lifter as in claim 9 wherein said ridges extend axially of the cylindrical body.

11. An engine valve lifter as in claim 9 wherein said lifter body first end includes two laterally spaced pairs of said spaced opposite sides each pair of sides receiving therebetween a roller rotatable on an axle pin formed with shallow convex cylindrical curvatures defining ridges transverse to the axle pin and limiting engagement of the roller with said opposite sides to engagement with said ridges.

12. A roller variable hydraulic valve lifter for an engine, said lifter including coaxial high and low lift cam followers selectively lockable for reciprocation together along a common axis, said high lift follower including a cylindrical body with inner and outer cylinder surfaces and a first annular end carrying a pair of laterally spaced high lift cam engaging rollers, said low lift follower including a hollow piston with at least one closed end, a second end and a cylindrical outer wall reciprocably engaging the inner surface of said body, the closed end carrying a low lift cam engaging roller generally between said pair of high lift cam engaging rollers, hydraulic lash adjusting means in the low lift cam follower and including a plunger reciprocable in said hollow piston and carrying a check valve, the plunger defining a high pressure chamber between the check valve and the closed end of the piston and an inner reservoir extending from the check valve toward the second end of the piston, and locking means including hydraulic locking pins reciprocably mounted in said body of the high lift follower for selectively locking the followers together for coincident reciprocating motion, said locking means further characterized by:

a saddle extending laterally across the closed end of said hollow piston between the high pressure chamber and the low lift cam engaging roller, said saddle having a concave cylindrical surface open toward said low lift roller and engagable by said locking pins upon their hydraulic actuation inward from said body, thereby causing the low lift follower to reciprocate with the high lift follower.

13. A roller variable hydraulic valve lifter as in claim 12 wherein said saddle cylindrical surface connects on arcuately opposite edges with angled sides forming a modified V recess open in the direction of said locking pins, and having the saddle cylindrical surface forming a closed base of the V recess.

14. A roller variable hydraulic valve lifter as in claim 13 wherein intersections of said saddle with said cylindrical outer wall of the low lift cam follower form angular edges engagable by said locking pins, said angular edges being contoured to reduce their sharpness and limit stresses in the hollow piston upon engagement of the locking pins.

15. A roller variable hydraulic valve lifter as in claim 12 wherein said high lift cam engaging rollers are supported on axle pins carried in transverse bores of said body, said rollers received within pockets opening through said first annular end of the body, said pockets having opposite sides engageable with said rollers for limiting their sideward motion, said sides of the pockets being formed with shallow convex cylindrical curvatures defining ridges transverse to the axle pins and limiting engagement of the rollers with the sides of the pockets to engagement with said ridges.

16. A roller variable hydraulic valve lifter as in claim 15 wherein said ridges extend axially of the cylindrical body.

17. A roller variable hydraulic valve lifter as in claim 15 including needle bearings disposed between said high lift cam engaging rollers and their axle pins, said needle bearings being retained within the rollers by engagement with said ridges.

* * * * *